United States Patent [19]

Thibault

[11] 4,111,618

[45] Sep. 5, 1978

[54] HYDRAULIC WHEEL II

[76] Inventor: Olida Thibault, 390 De la Briquade, Blainville, Terr. P.Q., Canada, J7C 2C8

[21] Appl. No.: 679,652

[22] Filed: Apr. 23, 1976

[51] Int. Cl.[2] ..... F03C 3/00; B60K 7/00

[52] U.S. Cl. ..... 418/152; 418/177; 180/66 F; 301/63 PW

[58] Field of Search ..... 418/131, 152, 177; 180/44 F, 66 F; 301/63 PW

[56] References Cited

U.S. PATENT DOCUMENTS

| | | | |
|---|---|---|---|
| 3,450,004 | 6/1969 | Ernst | 418/177 X |
| 3,639,093 | 2/1972 | Jansson | 418/177 |
| 3,674,385 | 7/1972 | Rohde et al. | 418/177 |
| 3,748,062 | 7/1973 | Wilcox | 418/177 |
| 3,811,737 | 5/1974 | Lejeune | 301/63 PW |
| 3,932,076 | 1/1976 | Thibault | 418/177 |

FOREIGN PATENT DOCUMENTS

| | | | |
|---|---|---|---|
| 1,372,357 | 11/1971 | United Kingdom | 301/63 PW |

*Primary Examiner*—Carlton R. Croyle
*Assistant Examiner*—Leonard Smith

[57] ABSTRACT

A light weight fluid energy converting device utilizing a fluid motor as supporting drive hub for a wheel or other driving attachments; the motor being of the reverse positioned vane type comprising a cylindrical rotor means enclosing a fluid channeled cammed stator actuating means, all supported on a basic stationary spindle by frictionless bearing means; one large end of the spindle being adapted to cycle a powering fluid in and out of the motor with an exterior controlled generating source; the motor housing, power ring, vanes, seal plates and stator body being constructed of light weight strong plastic materials easily adaptable for rapid mass production by known injection molding processes; the use of tubular metal coring assembly inserts embedded in the plastic mass serving as fluid flow channels and as stress relief reinforcing elements.

18 Claims, 16 Drawing Figures

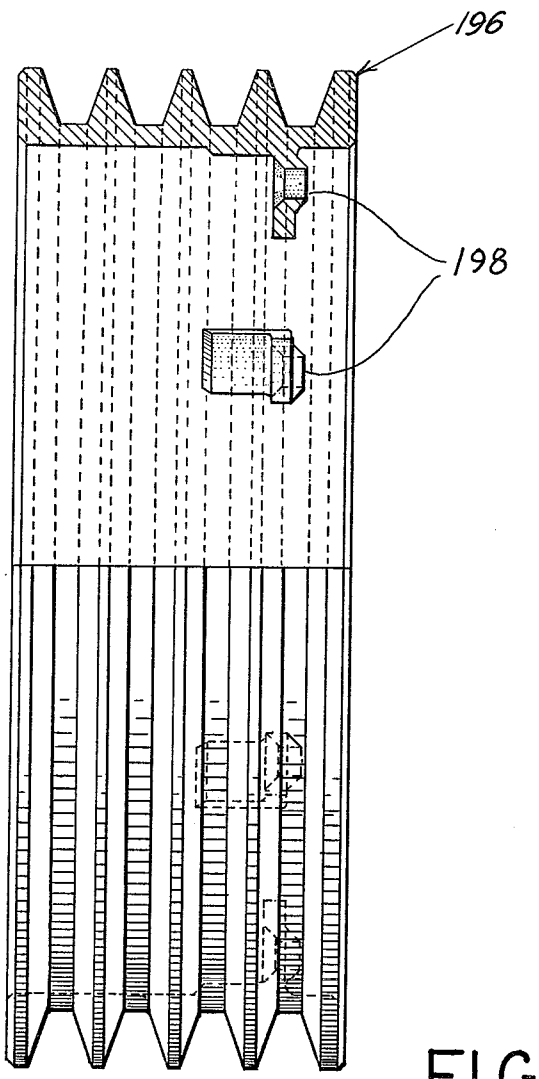
FIG. III
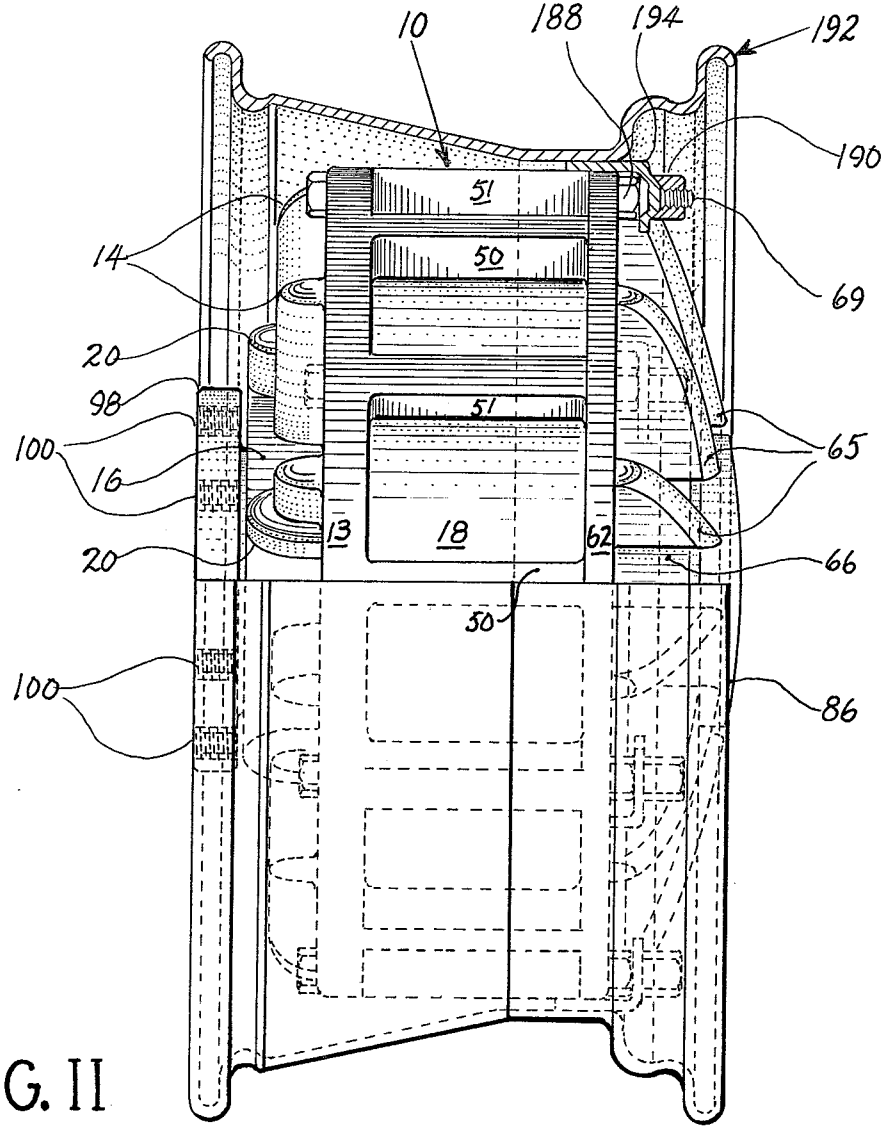
FIG. II

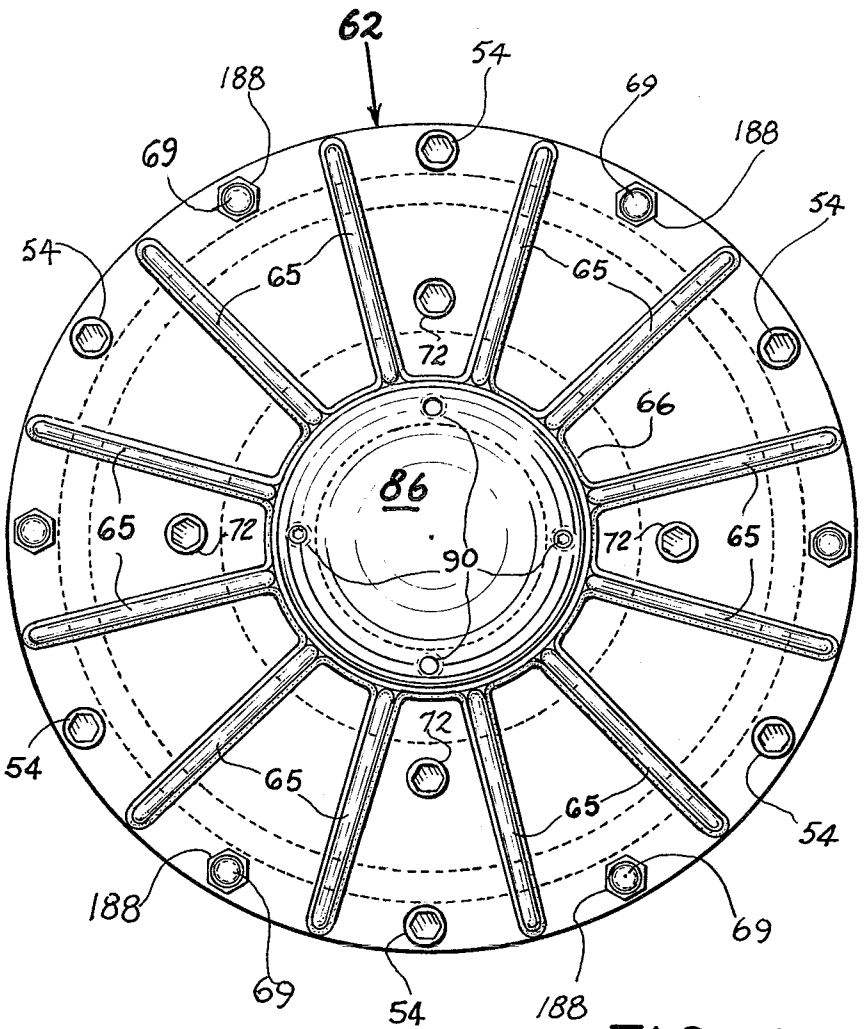
FIG. V
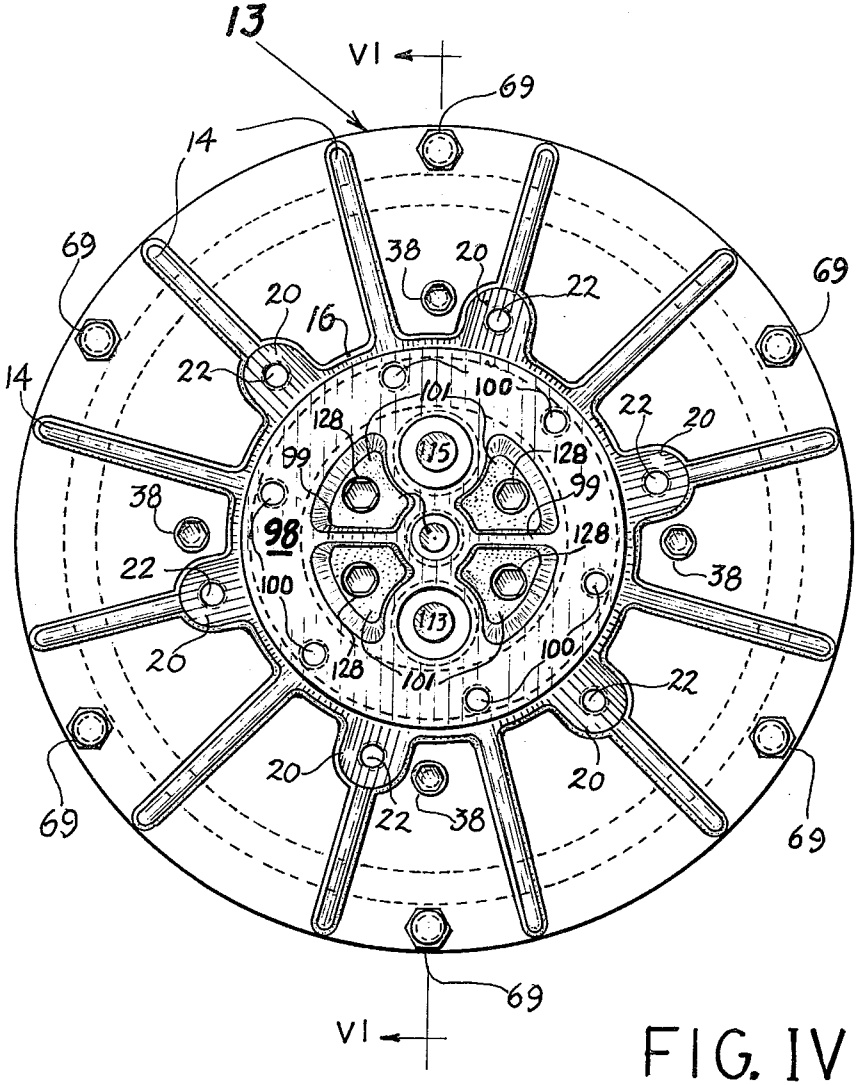
FIG. IV

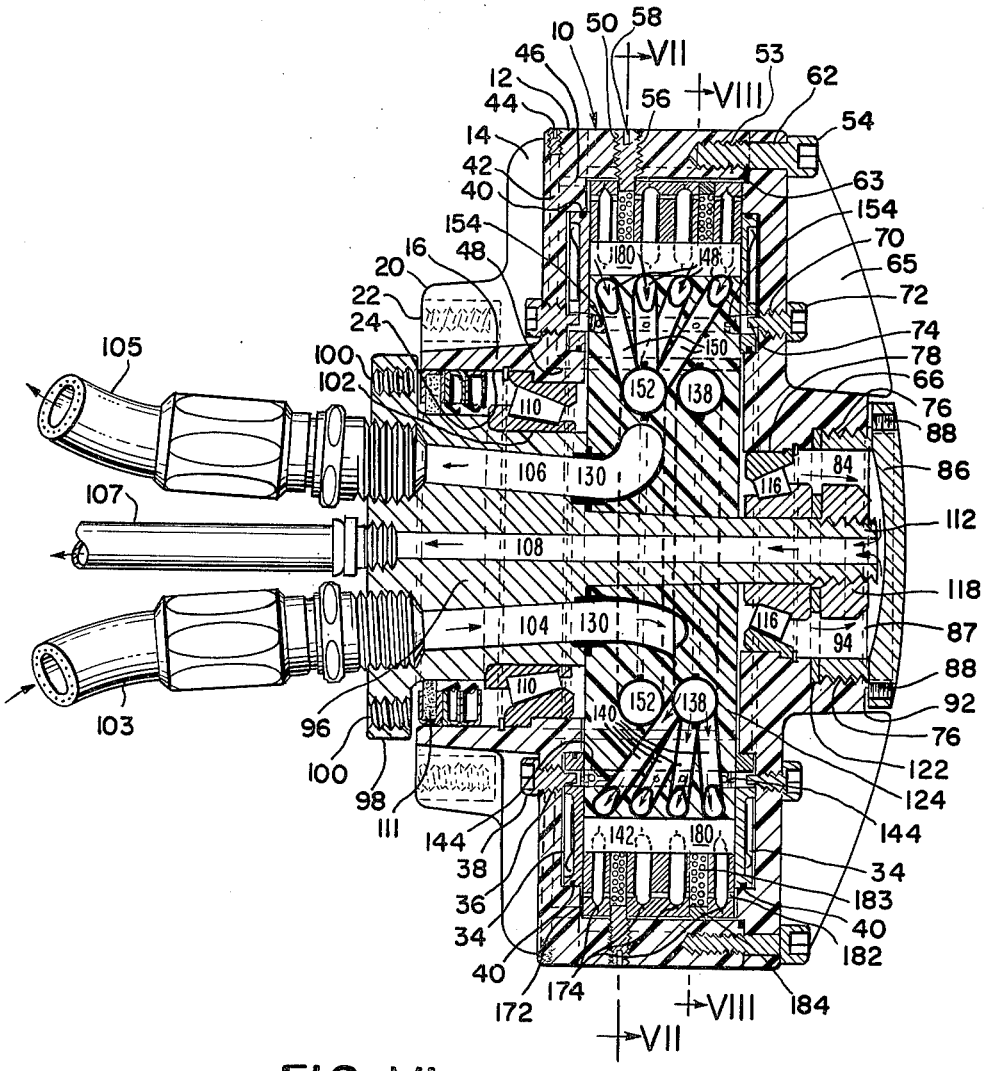
FIG. VI

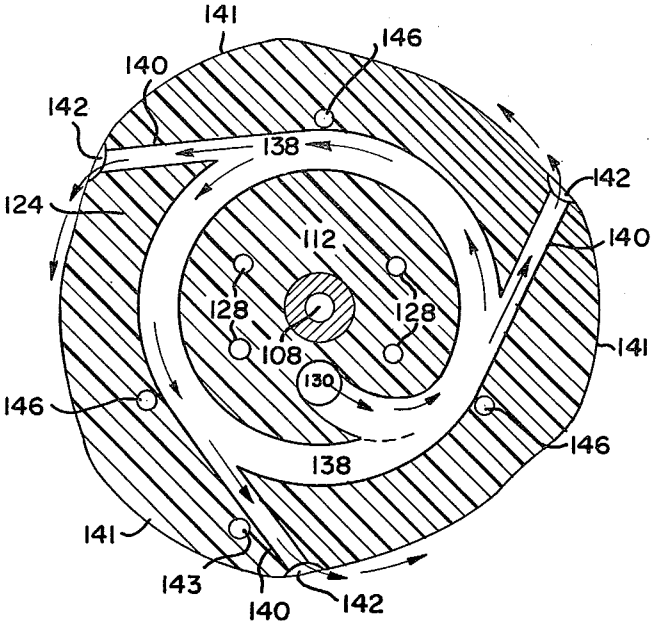
FIG. VIII
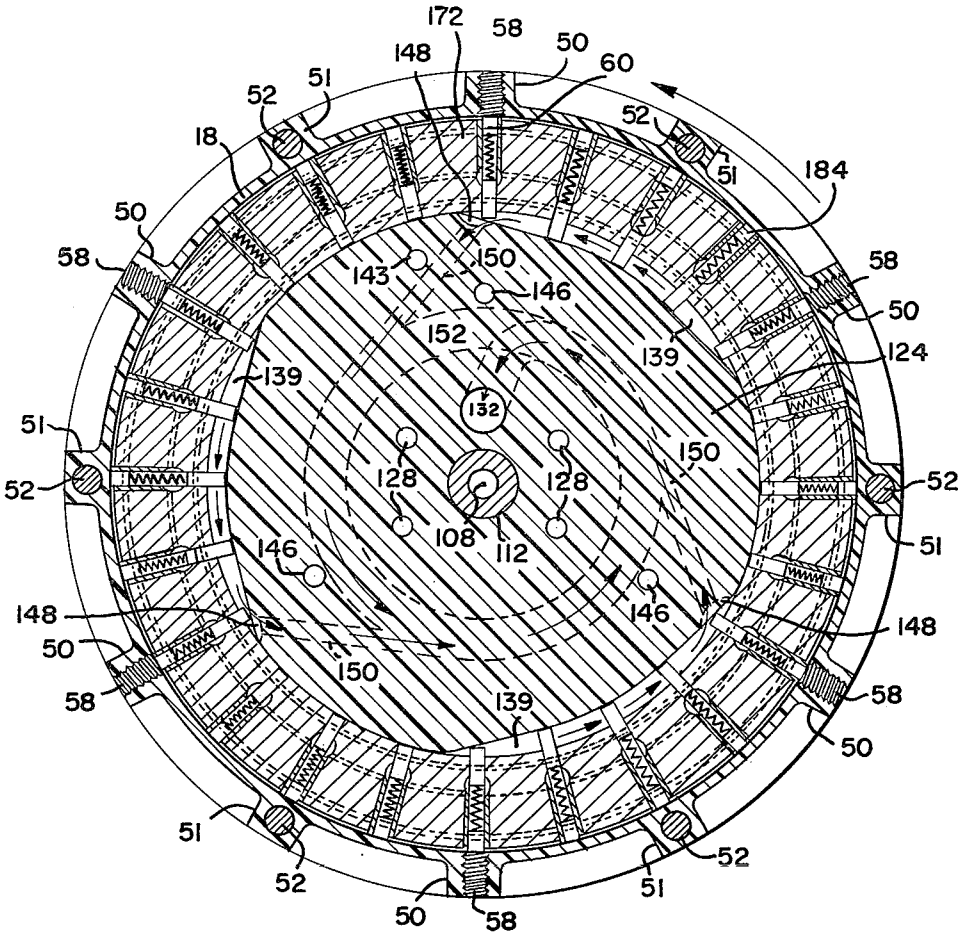
FIG. VII

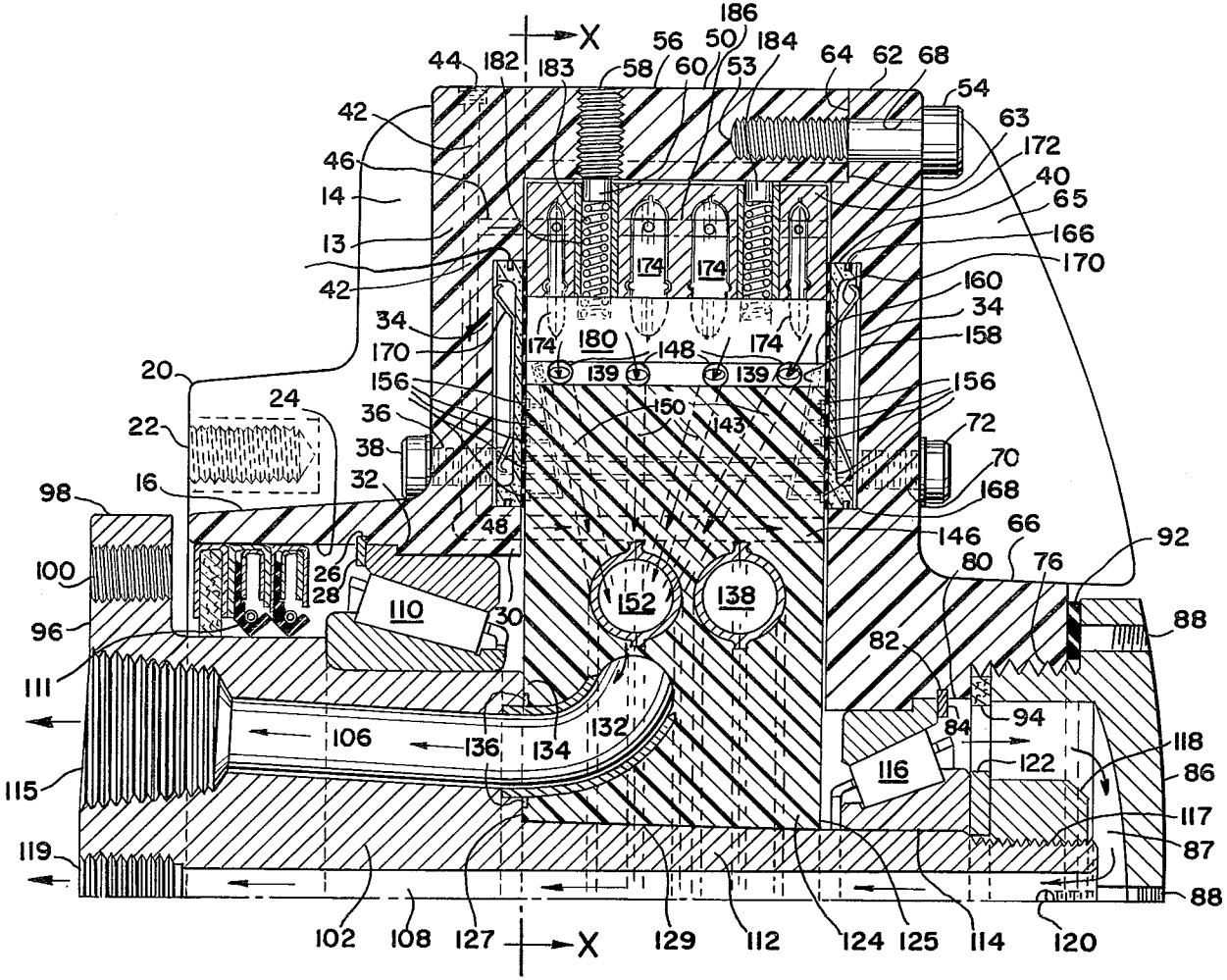
FIG. IX

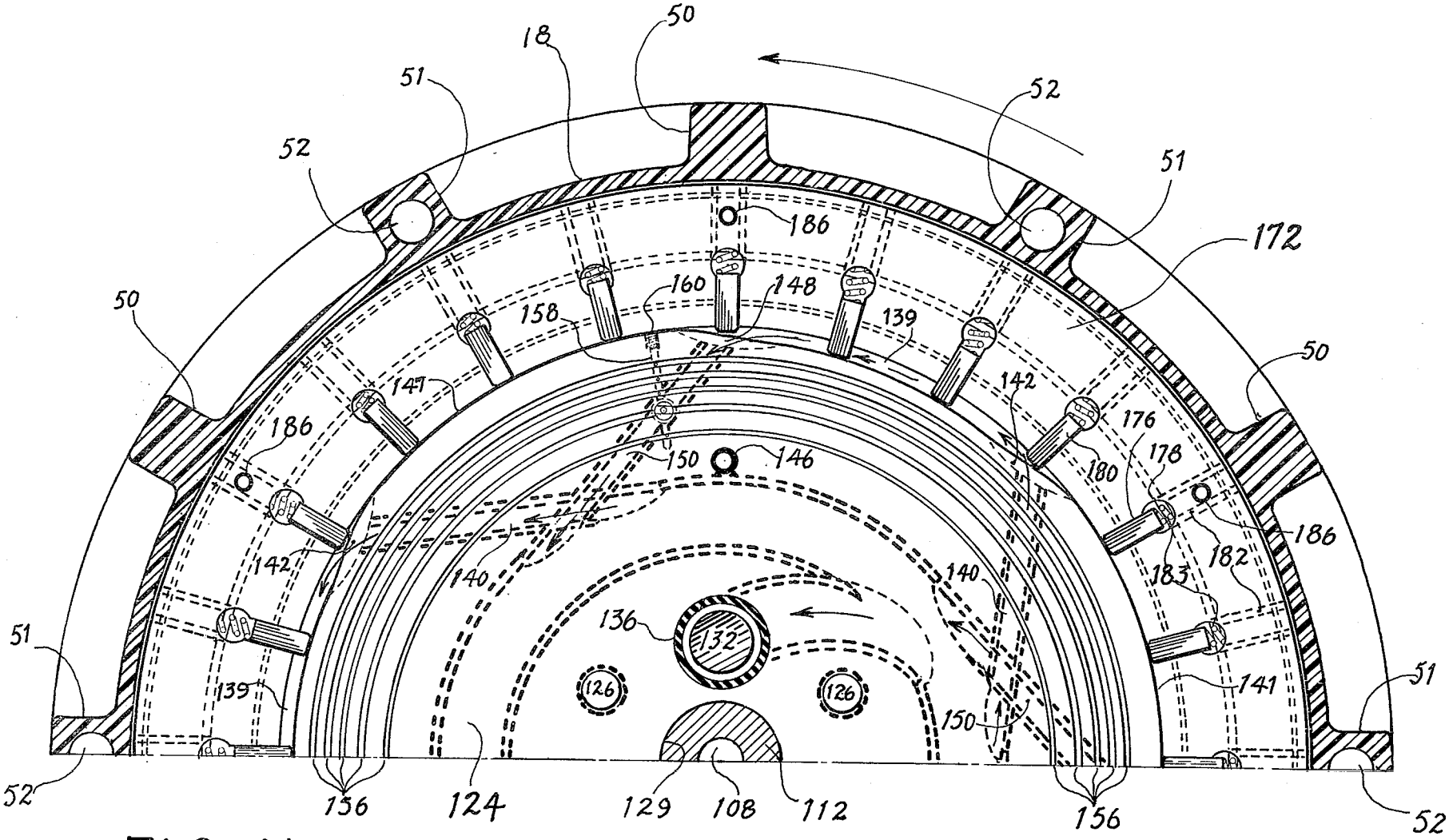
FIG. X

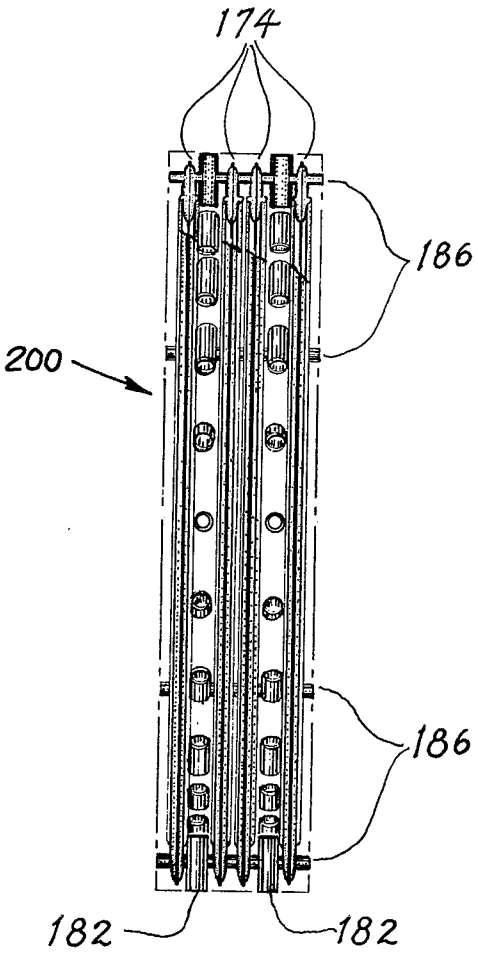
FIG. XII
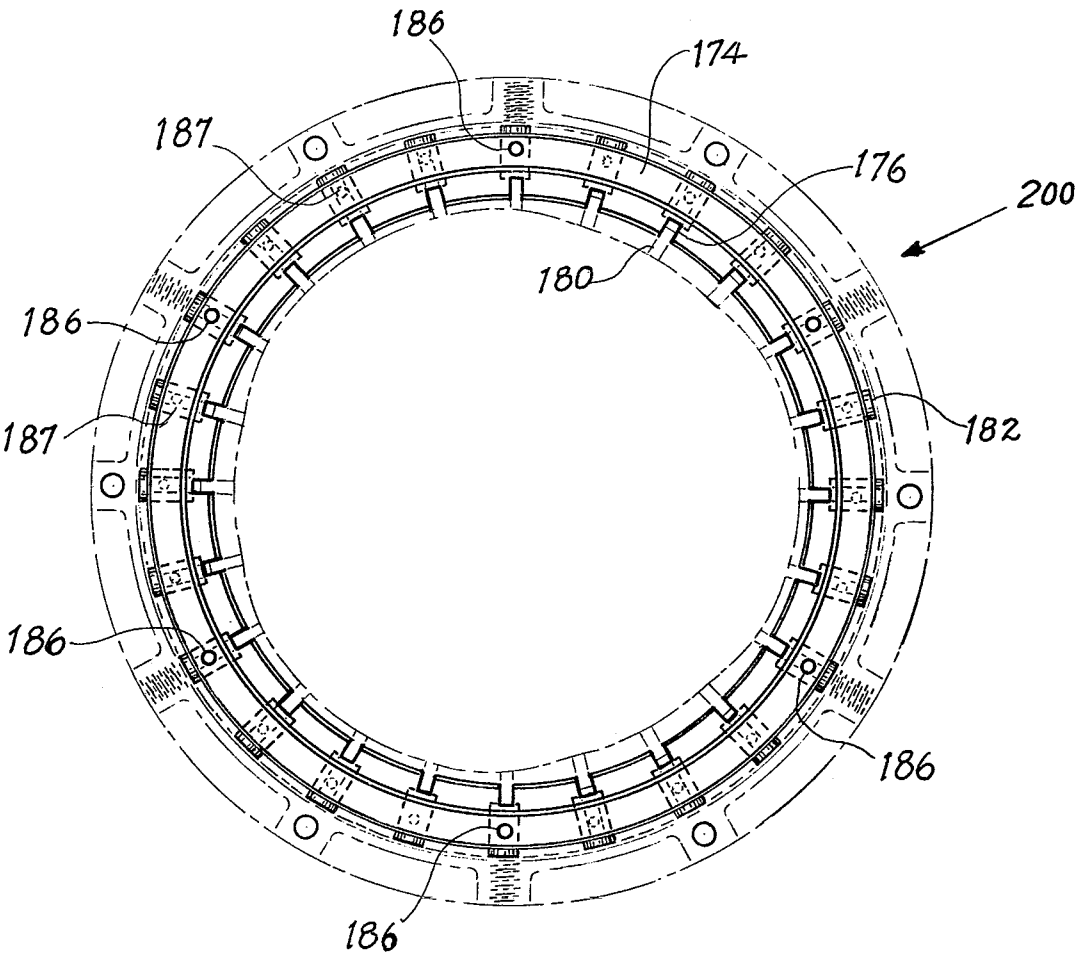
FIG. XI

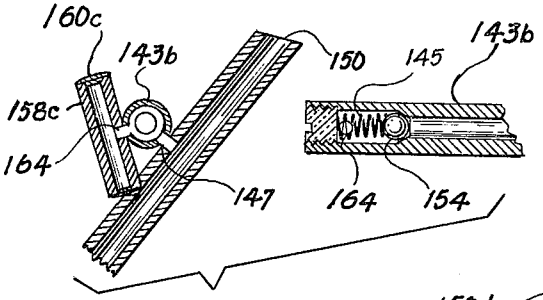
FIG. XIIIa
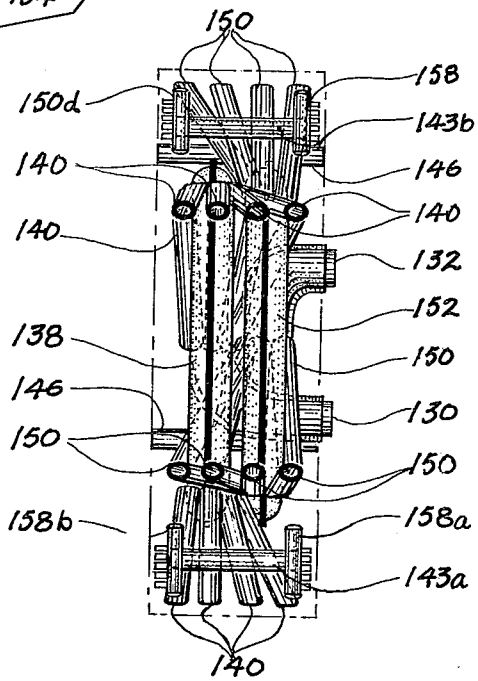
FIG. XIV
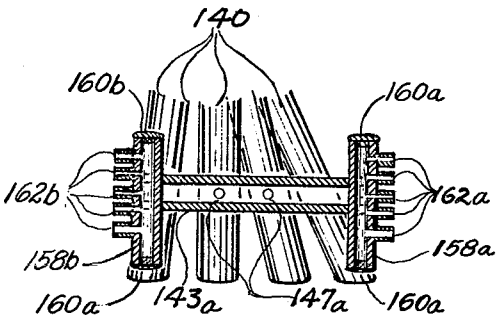
FIG. XIVa
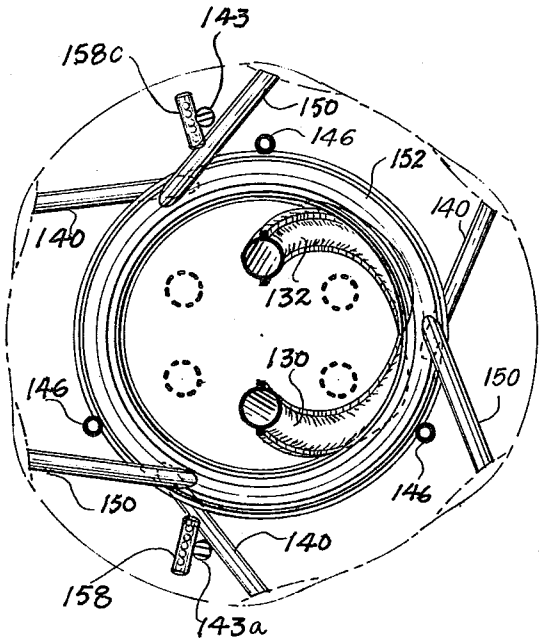
FIG. XIII

HYDRAULIC WHEEL II

BACKGROUND OF THE INVENTION

The present invention relates generally to an hydraulic WHEEL, wherein linear flow of a pressurized fluid, initiated from an exterior remotedly located source, is converted directly in a rotary motion of the rotor means by an hydraulic energy converting device. This invention relates to improvements to known fluid motors serving as a direct driving hub particularily adapted to supply torque to driving means releasably mounted theron such as: a pneumatic tire, a belt pulley, or other suitable driving attachments, or a combination thereof. The said fluid motor comprising a basic stationary portion and an exterior rotable portion, being so constructed and arranged as to form the direct driving element cased within the driven element of the wheel to propel a vehicle or to motorize a stationary machine or a combination thereof.

Previously disclosed hydraulic wheels, fabricated by conventional foundry and machine shop methods, using heavy weight marial such as ferrous metals, result in a bulky heavy weight and costly product suitable for low speed industrial machines in which suspended weight is no problem. Moreover, such a product is not adaptable to rapid, low cost, mass volume production by new modern manufacturing methods and processes such as injection die cast molding.

The present invention presents drastic modifications to known hydraulic wheels in order to reduce suspended weight when applied to fast moving vehicles such as automobiles and derivatives, and by adapting the design to low cost rapid mass production by using light weight easily processed materials such as the new reinforced polymer plastics having proven required characteristics, and also titanium alloy for the metal parts as the spindle.

Inherently, hydraulic wheel II is designed to operate in both directions of rotation with equal efficiency, symmetrical wheels can be mounted on either side of a vehicle capable of moving in both directions at equal speeds. The wheels can be used for dynamic braking by simple reversable fluid flow device, thus preserving conventional service brakes for life-time emergency and parking facilities.

Hydrau-static drive directly applied within the wheels offers great potentialities for automotive propulsion, especially when applied to multiple wheel drive as for "Jeeps", "Allterrain" trucks, farming and industrial machines. The substitution of: the live axles, angular gears and differentials, flexible shafts, transfer case and costly transmission elements by a far much simplified and less prime and maintenance cost hydraulic direct drive system, affording better traction, easy control and infinite speed range, should in a near future provide a good option for automotive vehicles, farm and industrial machines.

SUMMARY OF THE INVENTION

The present invention consist of a fluid motor serving as a direct drive hub supplying torque to a pneumatic tire or a pulley, or other suitable driving attachments releasably mounted thereon and forming part of a wheel for propelling a vehicle or motorizing a stationary machine, or a combination thereof.

The said motor is a light weight fluid energy converting device of the reverse positionned vane type in which the vanes, reacting to fluid linear flow, revolve with and inside the rotor housing around an inclosed stator, being the fluid energy actuator. The said plastic cylindrical housing is supported on a central stationary metal spindle by frictionless bearing means.

The spindle has a large bearing journal portion terminated exteriorly by a flange particularly adapted for mounting and affixing the wheel assembly to a vehicle frame or the support base of a stationary machine by releasable means. The said journal is bored through axially for three independent concentric oppositively located passageways to communicate with coinciding fluid metal cored channels inside the plastic stator body being mounted releasably on the stem inside portion of the spindle. Relatively large releasable fluid channels, flexible hoses or pipes or a combination thereof, are connected to the exterior ends of the said passageways to cycle the working fluid in and out of the fluid motor, from and to the fluid prime mover, a pump, being driven by a prime motor as the source of energy at a remote location.

On the cylindrical shaped stator, shallow arcuated depressions are molded on the periphery to define a plurality of equally distributed working chambers. Suceedingly descended vanes across the valleys of the working chambers, react against inrushing pressurized fluid to slide in trajectory revolutions around the camming periphery, compelling their copulated power ring in continuous rotation. The said working chambers are separated by equal intervening arcs terminated at both ends by smooth grade slopes. Both ends of the slopes are pierced by a plurality of metal tubular channels to flow pressurized fluid at one end and to exit drooping pressure fluid at the other end. The said tubes form part of two independent relatively large fluid metal manifolds, embedded in the plastic mass of the stator, that are in fluid communication with the passageways in the spindle large journal.

An annular plastic power ring encircles the stator cammed periphery with floating minimum operable clearance and serving as a continuous rotable ceiling thereon. The inner periphery of the power ring is indentated with a plurality of molded slots in which copulating plastic vanes slide radially with minimum fluid leakage. The powering vanes slide in the valleys; the idling vanes on the arcuated plateaus and serve as liquid tight barriers between the adjacent working chambers. The vanes are forced in liquid tight contact with the cammed contour by resilient metal spring means. The plastic power ring is relieved from the bulging force of the pressurized fluid by a plurality of strong metal torus caverns embedded in the plastic mass. The caverns serve also as leak-off fluid collecting and transfer chambers for the "pumping vanes" alternatively descending and ascending the hill slopes. Metal tubular guides, nesting the vane springs, are brazed radially to adjacent cavern faces and in liquid communication therewith. A plurality of metal tubes, piercing through the cavern bodies and both side faces of the power ring are in liquid communications with: the caverns, spring guides, vane slots and the exterior surrounding area of the power ring which is in positive floating engagement inside the rotor housing by releasable driving means. The said transversal tube serve to evacuate the leak-off fluid originating in the vane slots.

Two annular seal plates unified as piston-plates are made of special polymer combined compositions to afford strenght and very low coefficient of friction for the rubbing sliding surface. They are positioned in co-operative annular cylindrical shallow chambers molded in the plastic mass of both supporting end plates of the rotor housing and rotable with by releasable means. The seal plates serve as rotating continuous liquid tight walls for the working chambers by overlapping partly both faces of the power ring and the stator body. The seal plates are forced in sealing contact with the clasped elements, being brought in rotating alignment, by both resilient metal spring and fluid pressure means within the annular pressure chamber. Said fluid pressure derives from conduits leading to a pressurized large manifold inside the stator body. The exceeding friction pressure created by the seal plates against the rubbed surfaces of the stator faces is relaxed within operable conditions by a fluid balancing counter pressure device between the rubbed surfaces; fluid reversing valves are inter-connected in the pressure feeding conduits to permit the the reversal of the flow of the working fluid in the entire system, by external control, to reverse the direction of rotation of the wheel assembly or for dynamic braking as need may be. Inherently, the wheel motor is so constructed as to operate in both directions with equal efficiency, so identical wheels may be mounted on either sides of a vehicle.

The accumulating vane leak-off fluid in the caverns is flowed out of the motor assembly through a channelling system following the reinforcing tubular inserts embedded in the plastic mass of the: power ring, housing bottom plate and the stator body. The scavenged fluid intercept the bearing paths affording constant lubrication before leaving through the longitudinal central bore in the spindle.

The very particular feature of this invention resides in the construction of several component parts of the motor with reinforced polymer plastics. The plastic mass is releived from the strains and stresses of the bulging and bursting forces of the high pressure of the fluid by pre-fabricated strong metal hollow cores embedded in during the casting procedure. The said core inserts serve as smooth wall channels for maximum fluid flow. Also, titanium alloy may be substituted for steel for metal parts, such as the spindle, for maximum weight reduction.

Injection die casting in permanent precision steel molds provide a rapid economical means of production eliminating scores of foundry and machine shop operations.

The use of light metal alloys may substitute plastics where more severe duty of the hydraulic wheel is requested for driving farm and industrial machines such as: tractors, lifting trucks, hoist winches, conveyors etc.

SYNOPSIS OF THE NEW FEATURES IN THIS INVENTION (A) improvements of:
1. motor housing
2. power ring
3. vanes
4. stator
5. seal plates
6. spindle
7. balancing feed system
8. stator body channelling
9. leak-off scavenging system (B) funnels in the working chamber slopes
(C) polymer plastic material mass
(D) Metal hollow core inserts

DESCRIPTION OF THE DRAWING PLATES

FIG. I: Perspecting view of the fluid motor
FIG. II: wheel assembly with pneumatic tire rim
FIG. III: wheel assembly with "V" belt rim
FIG. IV: Rear view of the motor
FIG. V: Front view of the motor
FIG. VI: Diametrical cross-view of the motor
FIG. VII: Axial cut view taken on FIG. VI
FIG. VIII: Cut view of stator extracted form FIG. VII
FIG. IX: Quarter view, large scale extract from FIG. VI
FIG. X: Facial cut view, extract from FIG. IX
FIG. XI: Facial view of insert assembly, extract from FIG. VII
FIG. XII: Side view of FIG. XI
FIG. XIII and FIG. XIII*a:* Facial view, insert ass'y, extract from FIGS. VII; VIII
FIG. XIV and FIG. XIV*a:* Side view, insert ass'y, of FIG. XIII

DETAILED DESCRIPTION

HYDRAULIC WHEEL II

Figure 1:
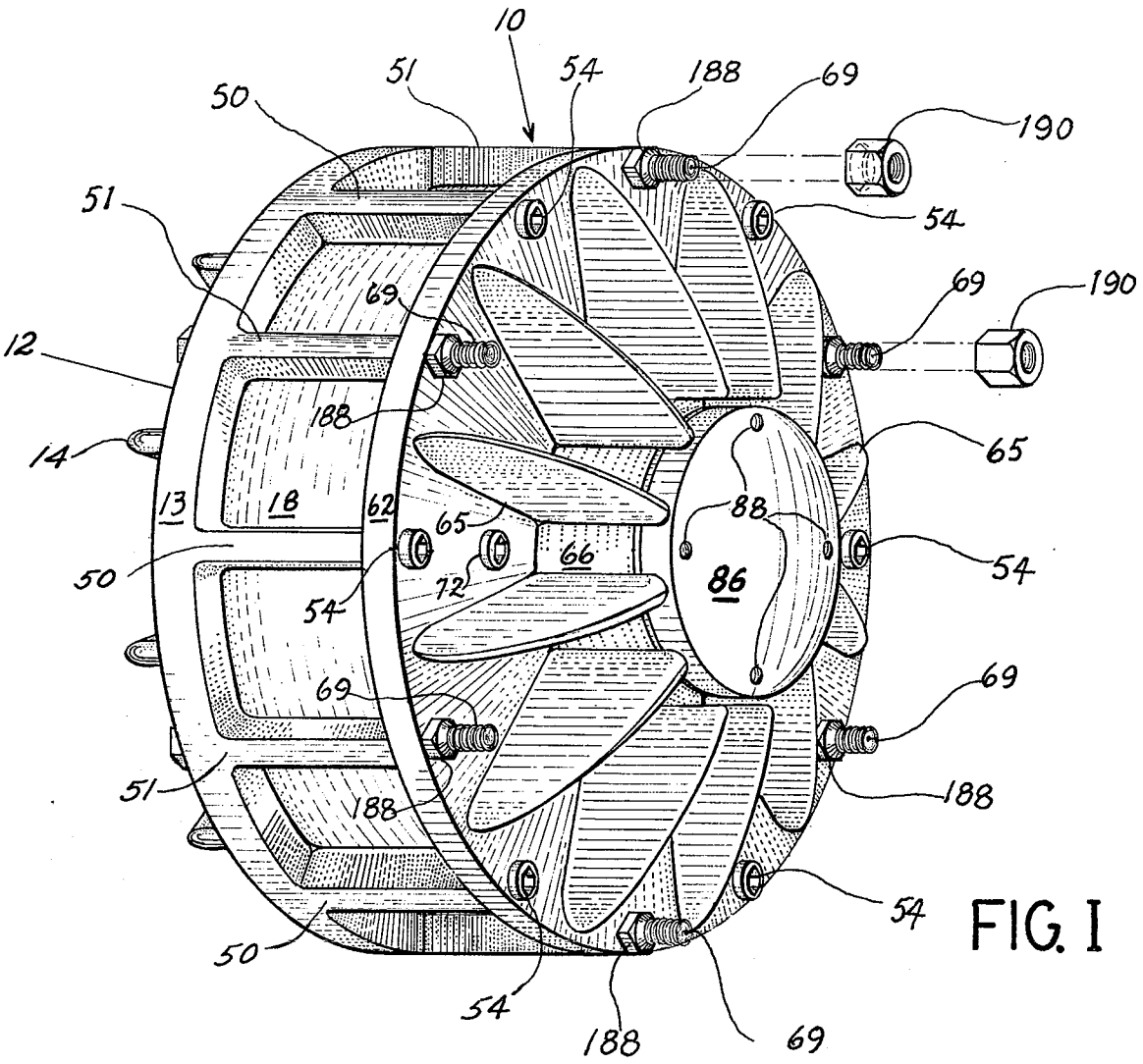

FIG. II shows a wheel assembly comprising the fluid motor 10 serving as a supporting drive hub mounted inside a pneumatic tire rim 192, with mode of attachment by releasable means through mounting lugs 194. The base portion of the lugs allow sufficient area between the rim and the motor housing 12 for the circulation of cooling air; FIG. III shows a "V" belt pulley 196 as an examplary optional driving accessory for a stationary industrial machine application.

FLUID MOTOR

FIG. I shows a perspective view of the fluid motor to drive said rim or pulley, or other suitable driving devices, exposing generally the exterior rotor portion, being the motor housing that comprises a cylindrical box 12 with cover plates 62 held in assembly by screws 54 and mounting bolts 69.

MOTOR HOUSING

The exterior rotor comprises a cylindrical plastic housing box 12 and cover plate 62 supported on a stationary spindle 96 by frictionless bearings 110, 116. The box has an annular flat bottom plate 13 encircling the bearing hub 16. Both plate and hub are reinforced externally by radial molded bracing ribs 14. The plastic mass is reinforced internally by radial tubular metal insert assembly 42,46,48 embedded into said tubes being in fluid communications with the interior of said housing box; The accessory mounting pads 20, identated on the hub extension, serve to affix a brake disc or suitable driving devices (not shown) by releasable means in threaded metal hole inserts 22, embedded in the plastic mass.

The housing box has an integrated annular closure wall designated as guide rim 18, braced externally by axial beams 50, 51 extending between the flanged portion of plate 13 and cover plate 62. Beams 50 have axial blind threaded holes 53 molded in the end for cover holding screws 54; radially threaded holes 56 for driving screws 58 serving as driving means for the interior power ring 172. Beams 51 have opened through molded holes 52 for the driving attachment mounting bolts 69.

Hub 16 has stepped molded bores 24, 30 to shoulder the flanged cup of large bearing 110 locked in bore 24 by lock ring 28 in machined groove 26. The combined dust seal and oil retainer 111 is pressed in the beginning of bore 24.

The housing cover consist of annular flat plate 62 surrounding hub 66 both braced by large radial cooling fins 65. The plate, fins and hub form an integrated molded plastic entity. Open holes 68 molded in the flange extension of the plate assembly serve for holding screws 54 and mounting bolts 69 for the driving accessories. Bearing hub 66 has three step molded bores: small bore 78 to shoulder the flanged cup of small bearing 116, bore 80 has a machined annular groove 82 for the cup locking ring 84, the molded threaded bore 84 in the hub extension serve for the releasable hub cap 86. The non-corrosive metal cap uses a soft metal oil seal ring 94 and a water tight resilient rubber ring 92. Assembly holes 88 on the concave cap face are partially threaded for releasable tamper-proofing plugs 90 sealed with wax. The flanged portion of cover plate 62 has a molded step riser 64 for accurate centering assembly in abutment with guide rim 18; resilient rubber "O" ring seal 63 make a liquid tight joint.

Both housing bottom plate 13 and cover plate 62 have shallow symmetrical annular pressure chambers 34 molded in their inner faces for positioning cooperative annular seal plates 40 rotatable with the said housing by releasable driving screw pins 38, 72 in molded threaded holes 36, 70 through the the said pressure chamber wall.

THE SPINDLE

The stationary spindle 96 serve as the basic support for the wheel assembly. A strong steel alloy die forging (titanium a good option for weight reduction) comprises: a large diameter journal 102 portion, a smaller slightly tapered stem 112, a small bearing journal 114 portion ending with thread 117 portion for releasable assembly holding nut 118. Large journal 102, being reduced to a minimum, allow sufficient space for axially drilled slanted inlet passageway 104 to flow working fluid inside motor, and a co-axial oppositevely drilled slanted outlet passageway 106 to flow out idling fluid. The said journal terminates with a large circular flange 98 adaptable to a suspended arm of a vehicle or a stationary support of a machine to which the wheel assembly may be affixed by releasable means, through threaded holes 100. As best seen on FIG. 5 the said journal has four sunken craters 101 to lodge the stator holding bolts 128 and to releive the weight mass. Said craters create narrow reinforcing ribs 99 and crosswise plateau ridge for large pipe-thread holes 113, 115 beginning passageways 104, 106 and for central axial P.T. hole 119 prolonged in a through bore 108 on the longitudinal axis of the spindle for the scavenging out of the interior leak-off fluid. The said journal is stepped; the minor circular surface support the bearing cone, the major provides smooth racing surface for the combined seal 111. The tapered stem 112 centralizes the releasable stator 124. The large diameter step riser face 134 contacts the stator face 127 aligning coinciding passageways 104, 106 with tunnels 130, 132 by stator holding bolts 128. Reselient "O" rings 136 in cooperative recesses on the stator face 127, around the tunnel extensions, make liquid-tight seals. At the beginning of thread end 117 a diametrical through hole is drilled for the locking split pin 120 of housing holding nut 118.

THE STATOR

Stator 124 is a cylindrical plastic block having two flat side walls 125, 127 and peripheral cammed contour 139, 141. It is mounted stationary on spindle 96, inside the rotor housing 12 and in running clearance with. The slight tapered central bore 129 eases the releasing and centers said stator on cooperative stem 112. Face 127 is held in sealed contact with riser face 134 of the large bearing journal 102 by bolts 128 screwing in metal thread inserts (not shown) embedded in the plastic mass of the stator body.

The stator is the actuator element of the fluid motor. On its periphery are defined a plurality of equally distributed shallow arcuated molded working chambers 139 separated by intervening arcs 141. The working chamber valleys 139 are joined to hill tops 141 by smooth grade slopes. The chamber ceilings are provided by the inner periphery of the encircling rotable power ring 172. The side walls are supplied by rotable seal plates 40. The working chambers simulate the function of hydraulic cylinders in which would slide working pistons. The pistons are being replaced by rectangular slidable vanes 180 descended across the valleys like gate slidable valves. The said gate vanes urged to slide on the curved valley floor by the force of inrushing pressurized working fluid fed through inlet ports 140 in the descending slopes. The vanes exiting the working chambers expel idling fluid in outlet ports 150.

As the idling vanes approach the ascending slopes, they bridge the beginning of the enlarging streaming long, narrow oval fluid collecting funnels 148, thus allowing a gradual droop of the pressurized fluid before exiting in outlets 150 being mouthed by the said collecting funnels. The other narrowing end of the funnel being prolonged slightly on the hill tops to ease the escape of the remaining fluid being entrapped and squeezed between the vanes, slope top and ceiling thus preventing "fluid locks" and minimizing back pressure flow; resulting in an increase of the hydraulic energy efficiency. Similar symmetrical funnels 142, mouthing inlet ports 140 in the descending slopes, have the same function when the fluid flow is being reversed in the working chambers, by a control exterior of the motor, for the reversal of the wheel rotation or for dynamic braking purposes as required.

Pressurized working fluid, being flowed inside the motor through suitable releasable channels (hose) 103 from a remotedly located fluid energizer (a pump), enters the spindle inlet passageway 104 communicating with metal elbowed inlet tunnel 130 welded to the large diameter torus distributing chamber 138 to which are welded a plurality of tangential fanning metal diffuser tubes 140 leading to distributing funnels 142 as mentionned before. The said pressurized channels inside the stator body constitute the working fluid first major manifold embedded in the plastic mass as part of the insert assembly 202 shown on FIGS. XII, XIV.

The drooping pressure idling fluid exiting the motor through a collecting second major manifold embedded along side in parallel and similar to the said first manifold, except for the tangential fanning collecting tube 150 being oppositively positionned to the diffusing tubes 140. The said second manifold (having an elbowed outlet tunnel 132 welded to transversally) communicating with exiting passageway 106 in the spindle journal to which is connected exteriorly releasable channel (hose) 105 leading the idling resourceable fluid to the reservoir of the cycling fluid mover. Both first and second manifolds are solidly and precisely joined together by transversal valve tubes 143 and leak-off scavenging tubes 146 forming the afore said insert assembly 202 embedded in the plastic mass of the stator body to releive same of internal bursting force of the highly pressurized fluid.

The outwardly portion of both stator side faces 125, 127, the working chambers 139 and the encircling power ring 172 are kept liquid tight by the two rotable clasping seal plates 40 being forced in clasping contact by both resilient metal spring and fluid pressure means. The resulting threatening rubbing friction is being relaxed by a counter balancing pressure system consisting of a plurality of co-axial concentric shallow grooves 156 molded in both faces 125, 127. Said grooves are being fed pressurized fluid by two communicating twin branched third and fourth minor manifolds connected respectivelly and oppositively to first and second afore said major manifolds. Said third manifold consisting of a transversal valve tube 143 to which are welded, near both ends, short radial groove distibuting tubes **158*a*, 158*b*, at right angle to tube 143; short axial groove feeding tubes 162 are welded respectively to said distributing tubes forming the branches of said twin branch manifold. The other twin branch fourth manifold is symmetric in shape and size to the third manifold having its axial transversal tube 143*b* welded to two collecting tubes 150 and in fluid communication with while the third manifold is welded to the diffuser tubes 140**.

Both valve tubes **143*a*, 143*b* have symmetric unidirectional valves: feeding valve 144 let pressurized fluid flow to groove 156 and inside the pressure chambers 134 of the pistonned seal plates 40; check valves 154 prevent escape of pressurized fluid in grooves 156** in the exiting collecting second manifold.

The function and the role of both feed and check valves are reversed when the direction of the fluid flow is changed in the entire system from exterior control, to achieve the reversal of direction of the wheel assembly. Inherently, symmetrical wheels are so constructed as to be adaptable on both sides of a vehicle and operate with equal efficiency.

FIGS. XIII, XIV on drawing sheet 9 illustrate the prefabricated manifold insert assembly 202 incorporating the four said manifolds precisely assembled and welded to the transversal valve and leak-off tubes 143, 146, in a positionning fixture to form one solid unit. The insert assembly is to be precisely located and secured in a permanent precision steel die mold to be filled with suitable polymer plastic by pressure injection. (light alloy metal could be substituted to plastic where a heavy duty wheel version is required). Such permanent metal inserted hollow cores have smooth interior walls, versus sand coring, lessening fluid flow friction, contributing to fluid energy efficiency. The finished product dispenses from scores of foundry and machine shop operations and is ready for assembly. Such known techniques and practice have provened economic time-saving in competitive manufacturing.

POWER RING

The power ring 172, located inside the rotor housing 12, is the linear fluid energy converter to rotable mechanical energy being transmitted to the rotor housing to which it is in positively floating engagement by driving pins 60 integral end parts of driving screws 58.

The said power ring is an annular plastic body reinforced internally by strong embedded metal permanent hollow core insert 200 releiving the plastic mass from the strong bulging forces exerted by the fluid in pressurized zones. The ring encircles the cammed contour of the stator with floating running clearance providing rotable continuous ceiling for the power chambers. A plurality of rectangular shaped radially sliding vanes 180 copulate the inner periphery of the said ring with minimum sliding clearance. At least two resilent metal springs 183 force the vanes in sliding liquid tight contact with the afore said cammed contour. The working vanes sliding along the arcuated working chamber valleys transmit their trajectory torque effort to the copulated power ring. The other vanes revolving on the hill tops 141 serve as liquid tight barriers preventing fluid pressure loss between the working chambers.

The vane retracting springs are lodged in metal tubular guides 182. The outer ends of a plurality of the guides serve to engage driving pins 60. Sufficient crosswise clearance between the pins and the guides allow the afore said floating play for the concentric positionning and alignment of the power ring with the stator. The other spring guides have free plastic plugs 184 backing against the inner plastic wall of guide rim 18 to serve as cushioning spring seats.

The large diameter metal torus caverns 174, embedded in the plastic mass, serve as fluid transfer chambers for the leak-off fluid coming from the vane slots 176. Such accumulating leak-off between the back of the vanes and the bottom of the slots must be "pumped" in and out to follow the reciprocal movements of the sliding vanes while alternately sliding up and down the hill slopes of the working chambers. The said cavern chambers provide a passageway for the fluid transfering from one vane slot to another by the "pumping" action of the vanes. This prefered feature of this invention is necessary to avoid "fluid squeeze," causing objectable fluid back-pressure, to increase fluid energy efficiency. A minimum leak-off is inevitable and desirable for the lubrication of the moving parts inside the said motor.

The large diameter tori are made of thick gauge steel stamping blanks (titanium alloy being a good option), pan shaped in a forming press with wall reinforcing ribs, cut-outs for sliding vane slots and punched holes for leak-off scavenging. Two symmetrical blanks are precisely positionned and welded together at the pan rims producing a long narrow oval shaped cross-section cavern chamber. The said spring guides are welded in radial position to the inner face of two adjacent tori being embedded near the side faces of the power ring. They are in fluid communication through apartures to allow "pumping action" inside the spring guides. The other tori are equally spaced in parallel between the two first tori. A plurality of leak-off metal scavenging tubes are passed axially through the punched apartures in the cavern walls, both end flush with the walls of the power ring. The said tubes having apartures to communicate inside the cavern chambers to allow free escape of the accumulating leak-off inside the surrounding rotor housing.

Caverns, spring guides and scavenging tubes are precisely positionned and brazed together, forming a strong pre-fabricated insert assembly 200 to be embedded in the plastic mass of the power ring by known injection die cast process.

SEAL PLATES

Two annular plastic seal plates 40, positioned inside cooperating annular shallow pressure chambers 34, molded in the two supporting end plates 13 and 62 of the rotor housing, serve as liquid tight rotable continuous sliding walls for the working chambers. Each plate is combined in a unitized very short skirt annular piston made of a special polyimide composition, reinforced internally by laminated woven cloth of Kevlar ® fibers. The annular rims of the piston skirts have molded circular grooves, in both inner and outer peripheries for resilient rubber "O" rings to seal the said piston-plate inside the cooperative annular chamber walls. The face on the annular membrane of the seal plate is impregnated with a porous polyimide composition DU. SP 811 ® containing graphite lead and Teflon fluorocarbon resin having a very low coefficient of friction in the presence of a lubricant.

The seal plates are rotable with the rotor housing by releasable driving pins being the end portion of driving screws 38 and 72, located through the annular pressure chambers bottom wall. The driving pins extent in the apartures in the membrane of the plates; said apartures facing one pressure balancing groove 56. Said driving pins are loose fit in said apartures affording fluid communication to the said annular pressure chambers 34. Annular resilient finger type springs 170, located on the bottom of the pressure chambers exert a force behind the seal plate membrane to bring the floating power ring in alignment with the stator while at rest. The fluid pressure introduced in the pressure chambers behind the piston plates is initiated in the power chambers and communicated through the balancing pressure circuit already described, and forces the seal plates in lubricating constant operative contact with both faces of the overlapped and clasped power ring and stator. The repelling force of the pressurized working chambers exerted against their free rotable walls, the seal plates, is neutralized by the force of equal gauge pressure exerted against a much larger total area behind the membrane of the seal plates. The resulting braking effect of the rubbing force of the plates, sliding on the stator faces, is counter-acted by the almost equivalent force inside the pressure balancing grooves. The excessive friction is thus relaxed within operable condition in cooperation with the capillary lubricating fluid on the lands separating the adjacent grooves, wetting the special anti-friction polyimide composition bounded on the faces of the seal plates.

LEAK-OFF FLUID SCAVENGING SYSTEM

As best seen on FIGS. VI and IX, the said system prevents excess leak-off liquid accumulation in the caverns, interferring with the vanes free movements, and accumulation in the bearing paths, endangering the dual oil seal 111 with pressurized fluid. The new improved and simplified scavenging circuit following the metal hollow cores in the power ring, in the bottom plate 13 of the rotor housing and the stator to flow the accumulating fluid in and through the bearing 110, 116, zones affording thus continuous lubrication thereto. The leak-off accumulating in the hub cap chamber 87 escapes through central bore 108 being connected to releasable hose 107 leading the resourceable leak-off back to the cycling pump reservoir.

I claim:

1. A light weight fluid motor having reversed position vanes revolving with and inside a cylindrical plastic rotor means around an inclosed plastic stator; said rotor means being supported on a basic stationary metal spindle by frictionless bearing means; said spindle affixing interiorly said stator releasably; said spindle being adapted to cycle powering fluid in and out of said stator; said stator having at least two shallow arcuated fluid power chambers molded on its circumference; both sloping ends of said chambers communicating respectively with a pressure feeding first major manifold and a drooping pressure exhausting second major manifold; said slopes having fluid pressure control means; said major manifolds being in communications, through said spindle, with an exterior fluid power generating source; said rotor means comprising a cylindrical plastic housing box enclosing an annular plastic power ring in floating positive engagement with by releasable driving means; the bottom of said box having inserted reinforcing tubes, both ends of which communicating with the interior of said housing box; said power ring encircling the camming contour of said stator body with minimal operable clearance; the inside periphery of said power ring being copulated by a plurality of radially slidable plastic vanes in cooperative slots; said vanes being biased inwardly in liquid sealing contact with said camming contour by resilient means; a plurality of powering vanes, descending successively in the power chambers, being repulsed in sliding trajectory by incoming pressurized powering fluid; said powering vanes relaxing when approaching the ascending slopes to expel out drooping pressure fluid in said exhausting manifold; the other vanes, sliding idlingly on the major camming arcs, serving as liquid sealing barriers between the adjacent power chambers; said power ring having collecting chambers for the leak-off fluid between the vanes and their slots; two annular plastic seal plates serving as, constant lubricated contact, side walls for said power chambers; said seal plates being positioned as pistons in cooperative pressure chambers molded in both end plates of said housing box; said seal plates overlapping partially both faces of said power ring and stator body with clasping force supplied by resilient and fluid pressure means inside said pressure chambers; said seal plates being in loose positive engagement with both housing end plates by releasable driving means; said seal plates rotating with the housing and the power ring; said seal plates sliding on a portion of both faces of said stator body; said pressure means inside the pressure chambers communicating with said power chambers through feeding minor manifolds embedded in the plastic mass of said stator body; said minor manifolds communicating with said major manifolds; said minor manifolds feeding also said friction relaxing means between the rubbed faces of said seal plates and stator body; uni-directional valves being interposed between the minor and the major manifolds to control flow directions to said friction relaxing means; said wheel motor having equal efficiency in both directions of rotation and capable of dynamic braking; a scavenging system means for exiting interior leak-off fluid out of said motor; said leak-off lubricating the interior moving parts; sealing means between said spindle and motor housing preventing exterior spoilage of said leak-off, being recuperable by recycling means.

2. A fluid motor according to claim 1, wherein said fluid collecting chambers of said power ring is a metal insert assembly embedded radially in the plastic mass;

said assembly comprising; a plurality of torus caverns, vane spring guides and scavenging tubes; each torus being fabricated by welding two half shell stampings together; said caverns having narrow, long elleptical walls with reinforcing ribs on the flanks; said caverns having a plurality of rectangular cut-off blanks on the inner periphery to coincide and communicate with said vane slots; the first two caverns being located near the inside faces of the power ring; a plurality of tubular spring guides being welded radially to the inner flanks of said caverns; other caverns being distributed equally, co-axially and in parallel between said first caverns; a plurality of scavenging tubes passing through transversally, welded at right angle to the flanks of said caverns; said tubes extending out flush with the side faces of the power ring, and being in communications with said caverns, spring guides, vane slots and the interior peripheral portion of said rotor housing; said insert assembly serving as permanent hollow cores in the molded mass; said cores serving as vane slippage fluid collecting and tranfer chambers and scavenging means; said insert components having steel or titanium alloy thick walls; said insert assemly releiving the plastic mass from high hydrastatic bulging stesses.

3. A fluid motor according to claim 1 wherein, said vanes are constructed of polymer plastics, said vanes comprising a core and a peripheral envelope; the core being constructed of a plurality of laminated plies of woven cloth made of strong Kevlar ® polyamide fiber strands; a narrow stip being saturated with a catalyzed polyester resin, being rolled a few plies in a flat bale; a final strip being saturated with a special "graphite-lead-fluorocarbon" additioned resin wrapping the said core; said bale shape being soaked in said additioned resin to be finally pressed and cured in a precise dimension permanent mold; said special additioned plastic having a very low coefficient of friction in the presence of a lubricant; said Kevlar plastic vanes being much lighter in weight and having a much higher bulk modulus then steel or titanium alloys.

4. A fluid motor according to claim 1 wherein, said seal plates for the power chambers consist of a one piece short skirt plastic annular piston; said piston having an annular relatively thin wall membrane integrated at both peripheries with short narrow rectangular rings; said membrane portion being composed of several annular laminates of Kevlar ® fiber strand woven cloth being impregnated with a fluorocarbon semi-flexible plastic resin; ring skirts being composed of reinforced polyester catalyzed resin bounding with the membrane portion in a precise dimension mold; said ring portions having shallow narrow grooved shaped on their circumferences for sealing means in said cooperative pressure chambers; the exterior flat face of the seal plates being coated with a thin layer of said special "graphite-lead-fluorocarbon" compostion to minimize said rubbing friction against the side faces of said stator body, in the presence of a lubricant.

5. A fluid motor according to claim 1, wherein said fluid scavenging system utilizes said scavenging tubes incorporated in the hollow core insert assemblies embedded in the plastic mass of said power ring, housing and stator body; said system utilizing the central bore of said spindle to exit the leak-off fluid out of the motor assembly; said system preventing fluid back-pressure hindering vane retractions in their copulated slots, and preventing pressurizing the seal means between the housing and said spindle; the interior deviating flow of said leak-off affording constant lubrication to said frictionless bearing means.

6. In an hydraulic wheel, a light weight fluid motor adapted as a supporting drive hub for a tire rim or pulley or other suitable driving attachments, releasably mounted thereon, said motor having reverse positioned vanes revolving with and inside a cylindrical plastic rotor means around an inclosed plastic stator activating means; said rotor means being supported on a basic metal spindle by frictionless bearing means; said spindle being adapted to flow a powering fluid in and out of said stator; said stator having at least two shallow arcuated power chambers molded on its periphery; both sloping ends of said chambers communicating respectively with a pressure fluid feeding first major manifold and a drooping pressure fluid exhausting second major manifold; said manifolds being connected with an exterior fluid power generating source; said rotor means comprising a cylindrical plastic housing box enclosing an annular plastic power ring in floating positive engagement with by releasable driving means; the bottom of said box having reinforcing inserted metal tubes; said power ring encircling the camming contour of the stator with minimal operable clearance; the inside periphery of said ring being copulated by a plurality of radially slidable plastic vanes in cooperative slots; said vanes being biased inwardly in liquid sealing contact with the camming contour by repulsive resilient means; a plurality of powering vanes descending successively in the power chambers being repulsed in sliding trajectory by incoming pressurized fluid; said powering vanes relaxing when ascending the oppositve slopes to expel out drooping pressure fluid in said exhausting manifold; both slopes having pressure control means; the other vanes sliding on the major camming arcs serving as liquid sealing barriers between adjacent power chambers; said power ring having collecting chambers for the vane slippage fluid; two annular plastic seal plates, serving as rotable side walls for the power chambers, being located in cooperative pressure chambers molded in both end plates of said housing box; said chambers being in communication with the power chambers through feeding minor manifolds; said manifolds feeding also an intermediate friction relaxing means for said seal plates; said minor manifolds being in communications with said major manifolds; uni-directional valves being interposed between said minor and major manifolds to control pressure flow directions to said friction relaxing means; said wheel motor having equal efficiency in both directions to rotation and being capable of dynamic braking; a scavenging system for exiting cumulative interior slippage leak-off fluid out of said motor assembly by recuperable recycling releasable conduits means.

7. A fluid motor according to claim 6, wherein said spindle is a light weight die-forging from Ti-6Al-4V titanium alloy, machine finished, said spindle having a large bearing journal portion at one end, an integral smaller stem portion at the other end; said large portion terminating exteriorly by an annular large affixing extension; said journal portion having stepped circumferences for sealing means race, and for shouldering and supporting one large bearing means; said journal portion being alleviated on the outer end by four sunk craters on both sides of a central diametrical ridge; said ridge being bored axially by two oppositevely located relatively large fluid channels for the cycling power fluid, and by a third smaller central channel extending throughout said stem portion for exiting said leak-off fluid; said craters being separated by narrow radial reinforcing ribs; the bottom of the craters being bored through for holding means of said releasable stator body; said large journal having an interior circular radial flat face to shoulder said stator with sealing means; said stem portion having a midway smaller bearing journal separated from the large journal by a tape-ring portion for centering and ease of releasing of said stator body; said stem terminating by a threaded portion having locking means for an adjustable releasable holding means.

8. A fluid motor according to claim 6, wherein said reinforcing tubular inserts are imbedded in the plastic or metal alloy mass of the bottom plate of said motor housing during the molding process; each insert being a thick wall steel or titanium alloy tube extending radially near the large bearing hub to the bottom plate rim periphery; said tubes being in fluid communications with the interior of said housing; said tubes forming part of said fluid leak-off scavenging system.

9. A fluid motor according to claim 6, wherein, said minor and major manifolds form part of insert assembly embedded in the plastic mass of said stator body, said insert assembly consisting of four manifold sub-assemblies: a pressure feeding first major maniflold, a drooped pressure exhausting second major manifold, a third minor feeding and a fourth minor reverse feeding manifolds; said sub-assemblies being joined together by welded to, scavenging and valve control feeding tubes; said elements being of steel or titanium alloy composition; said elements serving as permanent hollow cores during the injection process; said hollow cores as smooth clean wall channels for the powering fluid; said assembly releiving the plastic mass from high hydrostatic stresses.

10. A fluid motor according to claim 6, wherein, the plastic matter of said motor plastic components may be constituted of suitable known polymer compositions where commanded for light work duty of said wheel motor; said polymer resin being additioned of reinforcing elements such as: glass, asbestos, carbon, or other desirable fibers to produce high bulk modulus thermoplastics having long term mechanical and chemical stable properties to withstand evaluated stresses compulsing said components within a wide range of operating and climatic temperature conditions; said resin compound conforming to fast easy fill, short time cycle in injection precise molding processes.

11. A fluid motor according to claim 10, wherein, said thermoplastics may be substituted by light weight metal alloys of aluminum, magnesium or titanium base for the housing, power ring or stator components, where commanded for higher work duty applications of said wheel motor; said metal alloys having superior qualities to withstand higher evaluated stresses; said alloys conforming to suitable requirements for injection precise molding processes.

12. A fluid motor according to claim 9, wherein, said first feeding major manifold is a sub-assembly comprising: a large diameter distributing tubular torus, a plurality of feeding tubes and in inlet tunnel; said torus being fabricated of two half shell stampings welded together; a plurality of feeding tubes being welded tangentially to the outer periphery of said torus in a diffusing anti-clock wise direction into the descending slopes of said power chambers; an inlet elbowed tunnel being welded tranversally, at right angle, in an anti-clock direction to the inside periphery of said torus; the extension end of said tunnel to exceed out slightly the inside face of said stator body; said extension communicating with an inlet passageway in said enlarged portion of said spindle.

13. A fluid motor according to claim 12, wherein, said exhausting second major manifold is a sub-assembly similar and symmetric to said first major manifold except for the exhaust tubes fanning from the ascending slopes and for the exhausting tunnel being welded to the collecting torus in a clock wise direction; the tunnel extension communicating with an exhaust passageway in said spindle.

14. A fluid motor according to claim 12, wherein, said third minor manifold comprises: a transversal feeding tube, two feeding control valves, two distribution tubes and a plurality of short feeding tubes, said transversal feed tube being welded axially to said diffusing tubes of said first major manifold; said feed tube having feed control uni-directional valves at both ends; two distributing tubes being welded radially, at right angle, near both ends of said transversal tube; a plurality of short feeding tubes being welded axially, at right angle, to said two distributing tutubes; said short feed tubes piercing flush respectively through the bottom of annular pressure balancing grooves molded on both sides faces of said stator body; said balancing grooves forming part of said friction relaxing means; all said tubes and valves being in communications with said power chambers through said feeding first major manifold; said third manifold feeding the pressure chambers of said seal plates through driving apartures in the seal plate membranes and said balancing grooves when said wheel motor being rotated in the anti-clock direction.

15. A fluid motor according to claim 14, wherein, said fourth minor manifold is similar and symmetric to said third manifold; said fourth manifold being positioned oppositively to said third manifold in the stator body; said fourth manifold being in possible communications with the fanning exhaust tubes of said second major manifold being welded to; said fourth manifold feeding said balancing grooves only when wheel motor rotating clockwise.

16. A fluid motor according to claim 6, wherein, said pressure control means consist of a plurality of fluid exhaust funnels being molded in the ascending slopes of said power chambers. Said funnels mouthing the ports of the exhaust tubes of said second major manifold; said funnels being long, narrow, shallow, oval shaped depressions of which both oval apex being prolonged in narrow streaming grooves, extending slightly beyond both curvatures of said slopes; said grooves at the bottom of the slopes to depressurize and relax approaching working vanes; other grooves on the hill top to ease evacuation of entrapped fluid between exiting vanes, slope top and the rotating ceiling formed by the said power ring.

17. A fluid motor according to claim 16, wherein, a plurality of inlet funnels are molded in the descending slopes of said power chambers; said inlet funnels being identical and symmetric to said exhaust funnels; said inlet funnels mouthing the inlet ports of the diffusing tubes of said feeding first major manifold; the streaming grooves on the hill top to delay sudden pressurization of approaching idle vanes, freeing their inward radial sliding motion.

18. A fluid motor according to claim 17, wherein, the functions of said inlet funnels are changed with that of the said exhaust funnels, when the flow of the powering fluid being reversed in the wheel motor, from external control, to change direction of rotation of said motor or for dynamic braking.

* * * * *